US007931116B2

(12) United States Patent
Meyer et al.

(10) Patent No.: US 7,931,116 B2
(45) Date of Patent: Apr. 26, 2011

(54) TETRAHEDRAL LOUDSPEAKER

(75) Inventors: Derek W. Meyer, Truckee, CA (US); Aaron T. Emigh, Incline Village, NV (US)

(73) Assignee: Audible Technology, LLC, Incline Village, NV (US)

( * ) Notice: Subject to any disclaimer, the term of this patent is extended or adjusted under 35 U.S.C. 154(b) by 0 days.

(21) Appl. No.: 12/454,795

(22) Filed: May 22, 2009

(65) Prior Publication Data

US 2010/0294587 A1 Nov. 25, 2010

(51) Int. Cl.
*H04R 1/02* (2006.01)
*H04R 1/28* (2006.01)

(52) U.S. Cl. ..... 181/199; 381/345

(58) Field of Classification Search ..... 181/199, 181/148, 155, 156; 381/345
See application file for complete search history.

(56) References Cited

U.S. PATENT DOCUMENTS

| | | | | | |
|---|---|---|---|---|---|
| 2,337,213 | A | * | 12/1943 | Topping, Jr. | 181/156 |
| 2,955,669 | A | * | 10/1960 | Rice | 181/199 |
| 2,994,399 | A | * | 8/1961 | Zimmerman et al. | 181/152 |
| 3,203,502 | A | * | 8/1965 | Rife | 181/156 |
| 3,379,276 | A | * | 4/1968 | Goettl | 181/148 |
| 4,006,308 | A | * | 2/1977 | Ponsgen | 381/387 |
| 4,142,604 | A | | 3/1979 | Smith | |
| 4,249,037 | A | * | 2/1981 | Dexter | 381/308 |
| 4,325,454 | A | | 4/1982 | Humphrey | |
| 4,332,986 | A | * | 6/1982 | Butler | 381/349 |
| 4,348,552 | A | | 9/1982 | Siccone | |
| 4,787,472 | A | * | 11/1988 | Minnerath et al. | 181/145 |
| 5,097,514 | A | | 3/1992 | McNeill | |
| 5,123,500 | A | | 6/1992 | Malhoit et al. | |
| 5,266,751 | A | * | 11/1993 | Taguchi | 181/144 |
| 5,321,756 | A | * | 6/1994 | Patterson et al. | 381/308 |
| 5,436,976 | A | | 7/1995 | Dougherty | |
| 6,152,257 | A | * | 11/2000 | Denham | 181/155 |
| 6,721,431 | B1 | * | 4/2004 | Johnson | 381/336 |
| 2005/0089182 | A1 | * | 4/2005 | Troughton et al. | 381/307 |

OTHER PUBLICATIONS

TOA Corporation, "TOA Designer Speaker F-10B." Date unknown, retrieved on Feb. 7, 2009 from http://www.toa-corp.co.uk/user/data/F-10B.pdf.

TOA Corporation, "F-10B Tetrahedron Designer Speakers." Date unknown, retrieved on Mar. 20, 2009 from http://www.toa-corp.co.uk/asp/catalogue/products.asp?linkid=0&prodcode=F-10B.

* cited by examiner

*Primary Examiner* — Jeremy Luks

(57) ABSTRACT

In some embodiments, a subwoofer enclosure includes a substantially triangular first face, second face, third face, and fourth face, a first corner at an intersection of the first, second and third faces, a second corner at an intersection of the first, second and fourth faces, a third corner at an intersection of the first, third and fourth faces, a fourth corner at an intersection of the second, third and fourth faces, wherein an angle between the first corner and a midpoint between the third corner and the fourth corner, having the second corner as its vertex, is substantially ninety degrees, wherein an angle between the third corner and the fourth corner, having the second corner as its vertex, is substantially ninety degrees, and a subwoofer driver attached to the third face, having a free air resonant frequency less than one hundred Hertz.

20 Claims, 8 Drawing Sheets

TETRAHEDRAL LOUDSPEAKER

FIELD OF THE INVENTION

The present invention relates generally to the area of audio reproduction. More specifically, a tetrahedral loudspeaker is disclosed.

BACKGROUND OF THE INVENTION

There is great demand for loudspeakers that accurately reproduce sound, and for loudspeakers that are aesthetically attractive and/or easily integrated with a typical room.

Walls and corners of walls can help to propagate sound waves. However, walls, and especially corners, are often inconveniently placed relative to where a listener may choose to sit, particularly with respect to high-frequency sound, which can be highly directional. Additionally, conventional loudspeaker designs do not take full advantage of the acoustic benefits for low-frequency audio offered by corners, as conventional front-facing square speaker designs can fail to use the walls as effective waveguides, and can (e.g. from rear-facing ports) create interference patterns in the acoustic field.

Additionally, loudspeakers with sides that are perpendicular can be susceptible to "standing waves" as a result of interference between two waves moving in opposite directions, which can interfere with audio reproduction.

Accordingly, it would be useful to have a loudspeaker design without perpendicular sides, which can effectively make use of walls, a floor, and/or a ceiling as wave guide(s) at a corner for reproduction of low-frequency audio.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process, an apparatus, a system, a composition of matter, a computer readable medium such as a computer readable storage medium or a computer network wherein program instructions are sent over optical or electronic communication links. In this specification, these implementations, or any other form that the invention may take, may be referred to as techniques. In general, the order of the steps of disclosed processes may be altered within the scope of the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Figure 1A:
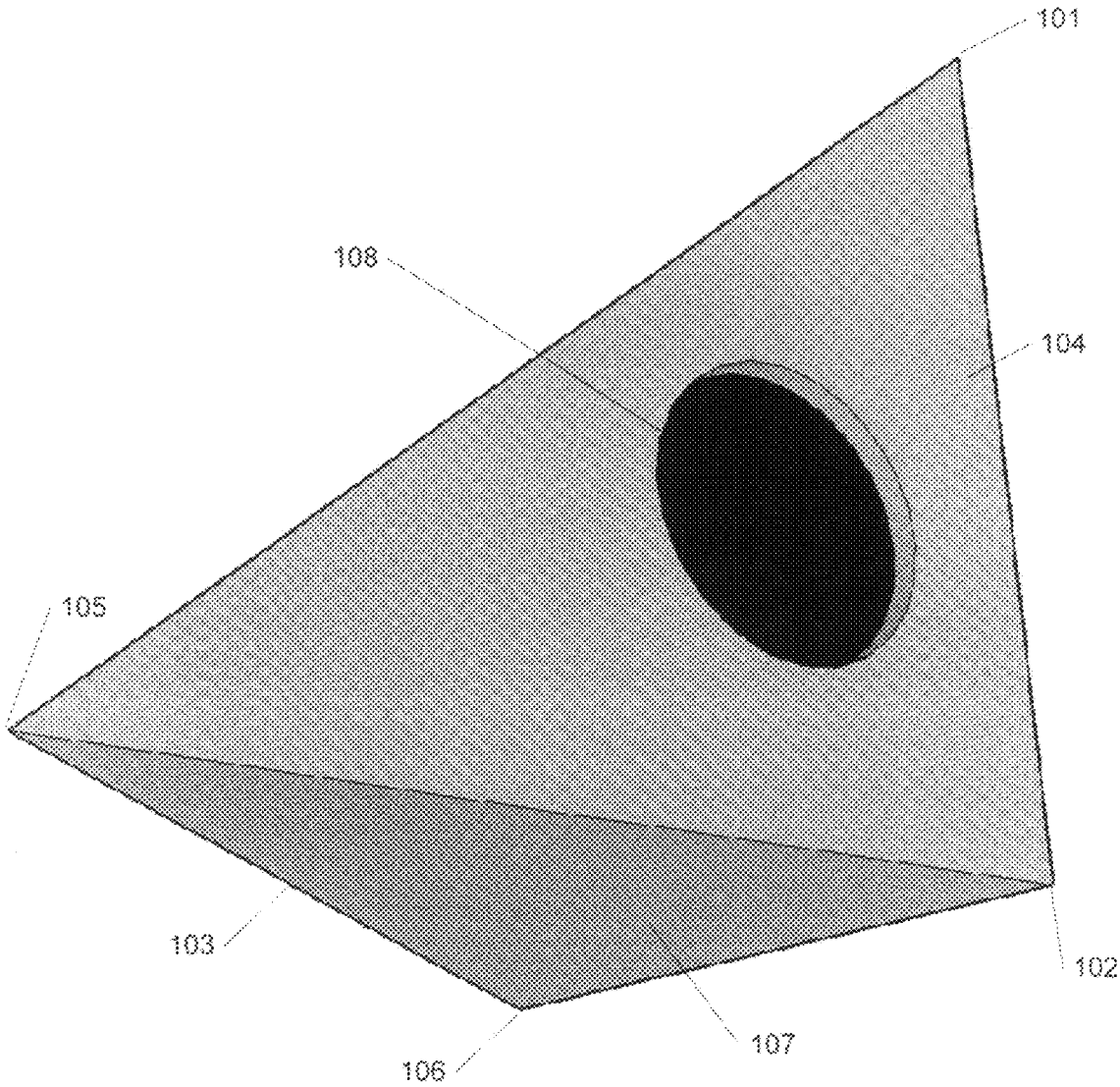
FIG. 1A is a diagram of a tetrahedral loudspeaker enclosure from a first perspective, according to some embodiments.
Figure 1B:
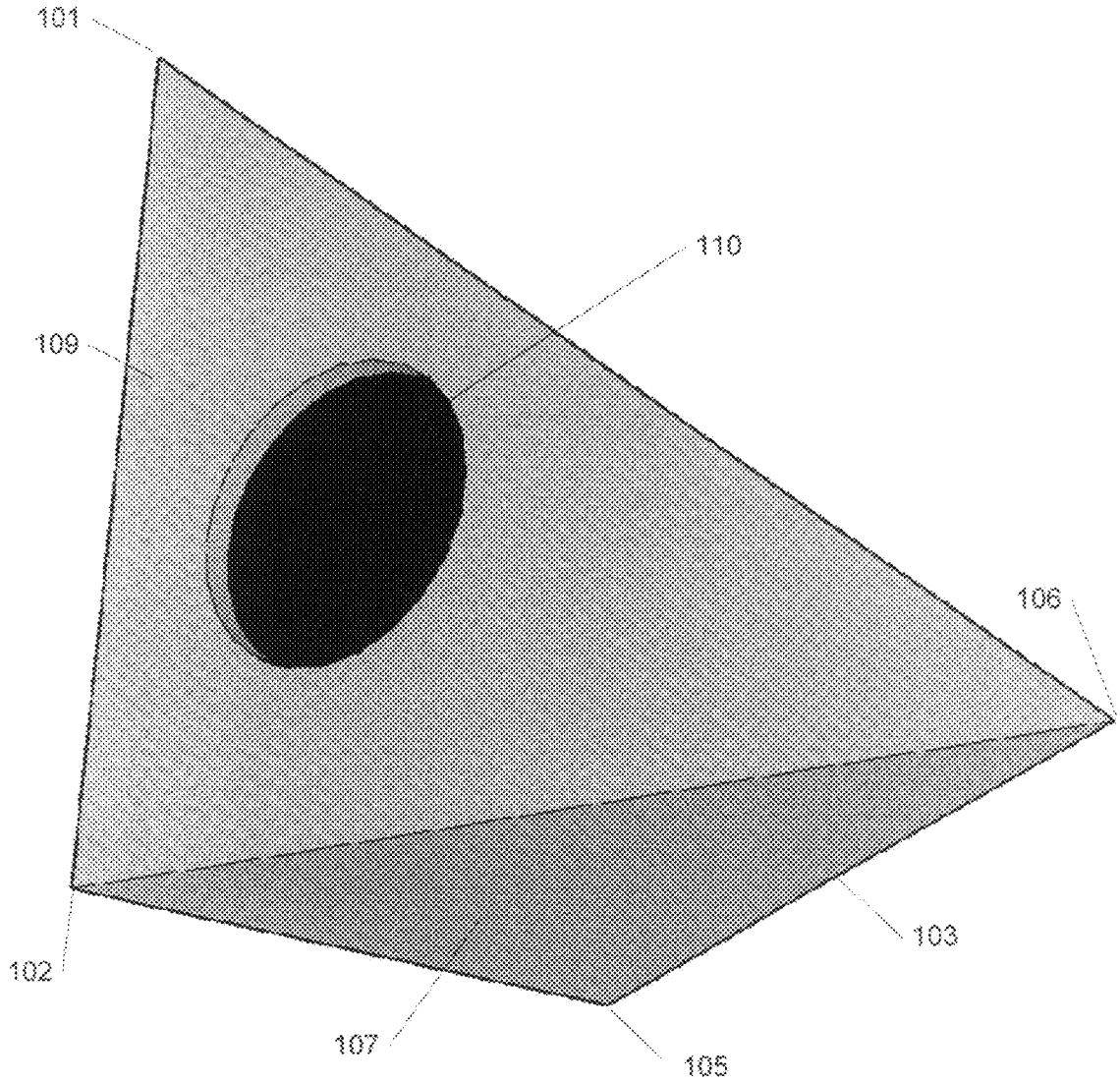
FIG. 1B is a diagram of a tetrahedral loudspeaker enclosure from a second perspective, according to some embodiments.

FIGS. 1A and 1B are diagrams of a tetrahedral loudspeaker enclosure from two perspectives, according to some embodiments. In this example, a top corner 101 is at the intersection of a right face 104, a left face 109 and a front face (not shown). A bottom corner 102 is at the intersection of a bottom face 107, right face 104, and left face 109. A right corner 105 is at the intersection of right face 104, the front face (not shown) and the bottom face 107. A left corner 106 is at the intersection of the left face 109, the front face (not shown) and the bottom face 107.

A "face" refers herein to a substantially flat (e.g. completely flat, or flat with portions that are removed, or flat with surface texturing, or flat with decorative elements in relief, or flat with protrusions accounting for a relatively small portion of the overall area, such as less than 10%) surface. In various embodiments, faces may be constructed of high-density fiberboard (HDF), medium-density fiberboard (MDF), plywood, carbon fiber, plastic (such as injection-molded plastic), solid wood, and/or natural or manmade stone. In some embodiments, faces may be constructed of different materials, such as a front face being constructed of a higher-density material than bottom face 107, right face 104, and left face 109. For example, the front face may be constructed of HDF while the other faces are constructed of MDF, or the front face may be constructed of natural or manmade stone or carbon fiber while the other faces are constructed of HDF, MDF, plastic, or wood. In some embodiments, faces may be constructed of a material between three eighths and three quarters of an inch thick, for example half an inch, or five eighths of an inch. In some embodiments, the front face may be constructed of or covered with a more aesthetically pleasing material than the other faces, such as a wood veneer, solid wood, carbon fiber, or a fabric covering.

A "corner" refers herein to an extremity of the enclosure that meets a plurality of faces. In various embodiments, a corner may be sharp, rounded, or flat (e.g. truncated, for example as shown in top corner 101 of FIG. 3). In some embodiments, a corner may be reinforced, e.g. with metal, solid wood, or natural or manmade stone.

The use of spatial terms such as "top," "bottom," "left" and "right" as used herein refer only to relative positions at a canonical orientation and not to absolute positions, as the overall enclosure may be oriented in various positions. In some embodiments, an enclosure may be oriented such that top corner 101 is at the physical top of the enclosure. In such embodiments, left corner 106 and right corner 105 would be to the left and right respectively. In some embodiments, an enclosure may be oriented such that top corner 101 is at the physical bottom of the enclosure. In such embodiments, bottom face 107 would be at the top of the enclosure, left corner 106 would be to the right, and right corner 105 would be to the left.

In some embodiments, right face 104 and left face 109 may be at right angles to one another, e.g. an angle between left corner 106 and right corner 105, measured at bottom corner 102, may be 90 degrees. In some embodiments, an edge between top corner 101 and bottom corner 102 may be perpendicular to bottom face 107, i.e. an angle between top corner 101 and a midpoint 103 of a front edge between left corner 106 and right corner 107 may be 90 degrees. An example of an application of such right-angle geometry is that the enclosure may be oriented substantially against a corner of a room (e.g. flush with the corner of the room, or with a substantially equidistant gap between left face 109 and a first wall of the corner, and between right face 15 and a second wall of the corner), with bottom face 107 parallel (e.g. flush with, or substantially equidistant to over its surface) to a floor, or a ceiling.

Bottom face 107, left face 109, right face 104, and a front face may be triangular. "Triangular" refers herein to having three sides, or to having substantially three sides (e.g. a triangle with one or more corners truncated).

In some embodiments, right face 104 may have a right radiator 108. A radiator refers herein to an aperture through which sound may pass out-of-phase to a primary driver. Examples of a radiator include a port (including without loss of generality a tuned port), a passive driver having a membrane, such as a Tymphany 830878, and an active driver, such as a Tymphany 830856, operating out-of-phase (for example 180 degrees out of phase) with a primary driver. An example of operating an active radiator driver out of phase with a primary driver is to provide inputs to the active radiator driver with reversed polarity to those provided to the primary driver. In some embodiments, an input to an active radiator driver may be attenuated relative to the input to the primary driver. In some embodiments, left face 109 may have a left radiator 110. While radiators are shown round for expositional consistency, radiators may be round or any other shape, such as a slot or slit, oval, ellipse, rectangle, etc.

In some embodiments, a radiator may face a chamber within a baffled enclosure. Such baffling and chambers are known to those skilled in the art.

In some embodiments, left face 109 and right face 104 may have one or more protrusions, such as flanges or rubber bumpers, which may help center the speaker flush against walls while leaving a gap for right and left radiators 108, 110. In some embodiments, for example when there are no right and left radiators 108, 110, left face 109 and right face 104 may have a flush-fitting soft substance such as acoustic foam or rubber, for example around their edges, which may provide a snug fit against walls and prevent rattling. In some embodiments, left face 109 and right face 104 may be fitted with mounting brackets enabling them to be firmly affixed to walls.

In some embodiments, the enclosure may have an inner volume of between 150 and 270 cubic inches, for example approximately or exactly 213.5 cubic inches. In some embodiments, edges radiating from bottom corner 102 to top corner 101, left corner 106, and right corner 105 may have an interior length of between 9 and 13 inches, for example approximately or exactly 10.9 inches. In some embodiments, edges of front face 201 of FIG. 2 (i.e. between top corner 101 and left corner 106, between left corner 106 and right corner 105, and between right corner 105 and top corner 101) may have an interior length of between 12 and 18 inches, for example approximately or exactly 15.3 inches.

The enclosure may be trirectangular, e.g. at bottom corner 102, the edges to top corner 101, left corner 106, and right corner 105, may be mutually perpendicular. A dihedral angle between front face 201 of FIG. 2 and bottom face 107, between front face 201 of FIG. 2 and left face 109, and between front face 201 of FIG. 2 and right face 104, may be approximately or exactly 90 degrees (i.e. pi divided by two radians) minus the inverse cosine of the square root of two thirds of a radian, or approximately or exactly 54.74 degrees (i.e. 0.9553 radians).

Figure 2:
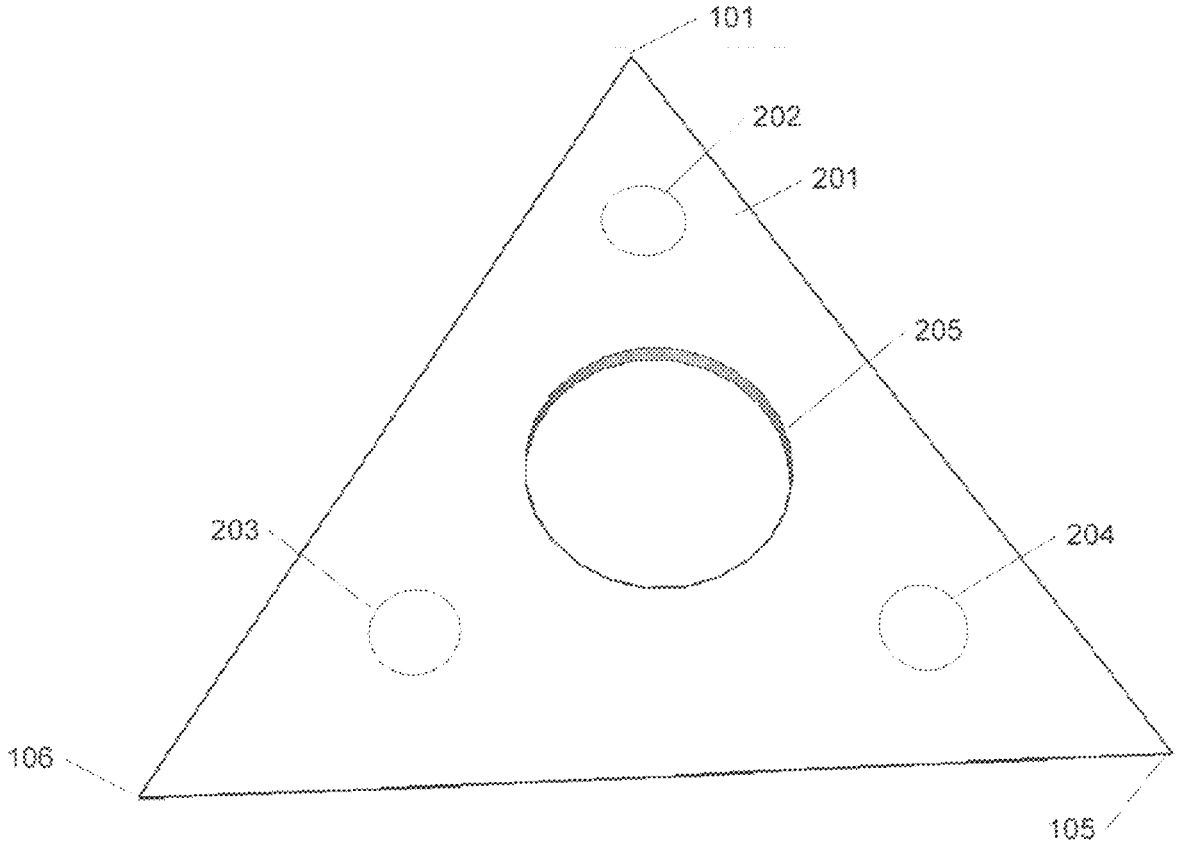
FIG. 2 is a diagram of a front face of a loudspeaker enclosure, according to some embodiments.

FIG. 2 is a diagram of a front face of a loudspeaker enclosure, according to some embodiments. In this example, front face 201 meets top corner 101, left corner 106, and right corner 105.

In some embodiments, front face 201 may be equilateral, or substantially equilateral. Equilateral refers herein to having equal sides, or to having equal sides if the sides are extrapolated to the points at which they meet (e.g. a face of an equilateral triangle with a corner truncated could still be considered to be equilateral). In some embodiments, front face 201 may have the same angle relative to bottom face 107, left face 109, and right face 104. An example of a benefit of such a configuration is that a consistent wave pattern may be achieved from each of the walls and ceiling/floor adjacent to front face 201, which may effectively be used as wave guides.

A subwoofer driver 205 may be attached to front face 201. A subwoofer driver may be an audio driver that produces sound waves in response to electrical impulses, which is designed to produce sound waves at frequencies below an upper threshold frequency or frequency range that is within range of human hearing. A subwoofer driver may have a free air resonant frequency of less than 100 Hz. Such a free air resonant frequency is known to those skilled in the art, and refers to the resonant frequency of the subwoofer driver's voice coil with the driver suspended in free air. Free air resonant frequency may be the Thiele/Small "Fs" parameter known to those skilled in the art, for example as discussed in the Wikipedia article for "Thiele/Small," available online as of May 20, 2009, which is herein incorporated in its entirety by reference for all purposes. At the free air resonant frequency, the driver may have maximum impedance. An example of a subwoofer driver is a Tymphany 830856. In some embodiments, every driver, or every active driver, associated with the enclosure may be a subwoofer driver.

A frequency-based filter, such as an analog frequency-based filter or a digital frequency-based filter, which are known to those skilled in the art, may clip or attenuate frequencies above an upper threshold, and/or attenuate signals progressively throughout an upper threshold range (e.g. using a low-pass filter or a band-pass filter, which is considered herein to be a combination of a low-pass filter and a high-pass filter), and/or may clip or attenuate frequencies below a lower threshold, and/or attenuate signals progressively throughout a lower threshold range (e.g. using a high-pass filter), for example as discussed in conjunction with FIG. 6. A frequency-based filter may be internal (e.g. within the enclosure) or external (e.g. outside the enclosure), and may be integral with or separate from the enclosure.

In some embodiments, a wireless receiver within the enclosure may receive radio-frequency signals, for example via 802.11a, 802.11b, 802.11g, or Bluetooth, and convert them to electrical signals encoding audio, which in some embodiments may include decoding a digital bit sequence, decompressing a digital bit sequence, and/or converting a digital bit sequence to analog. Examples of digital bit sequences include PCM, MP3 and AAC encodings. In some embodiments, a wireless receiver may connect to inputs of an internal audio amplifier.

In some embodiments, an audio amplifier may be included within the enclosure. In such embodiments, a power connector and/or cord may be provided to power the amplifier, and the amplifier may connect to inputs of a subwoofer driver.

In some embodiments, subwoofer driver 205 may be in the geometric center of front face 201. For example, its center may be equidistant or substantially equidistant from top corner 11, left corner 106, and right corner 105.

In some embodiments, subwoofer driver 205 may be inset, for example so its furthest protrusion is level with front face 201, or inset from front face 201. An example of an advantage of insetting subwoofer driver 205 is to minimize diffractive interference.

In some embodiments, one or more front radiators 202, 203, 204, such as three front radiators, may be within front face 201.

In some embodiments, the enclosure may be sealed, i.e. without a radiator.

Figure 3:
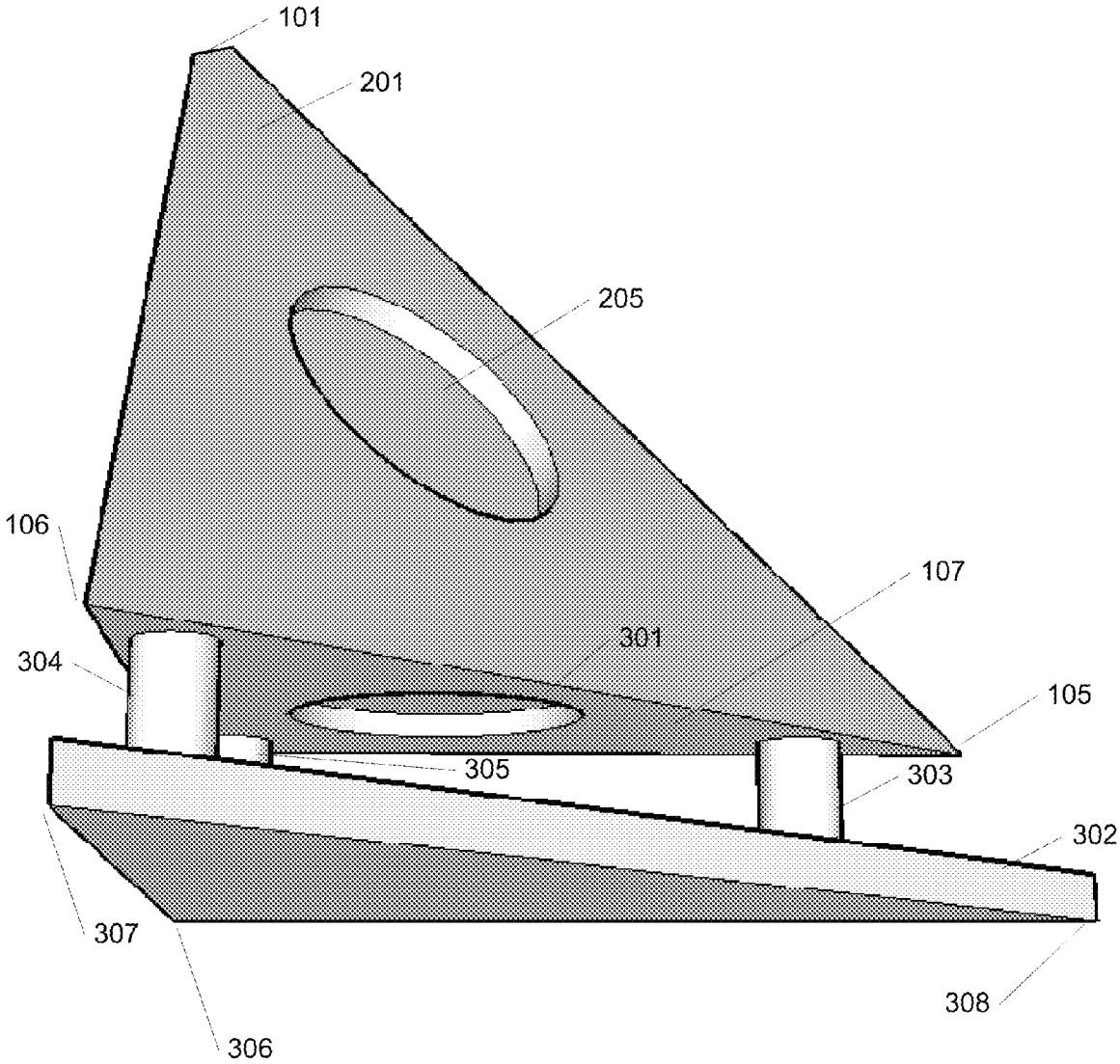
FIG. 3 is a diagram of a loudspeaker enclosure affixed to a base, according to some embodiments.

FIG. 3 is a diagram of a loudspeaker enclosure affixed to a base, according to some embodiments. In this example, bottom face 107 has a bottom radiator 301.

A base 302 may be substantially triangular, for example triangular or triangular with one or more corners truncated and/or rounded. In some embodiments, base 302 may be constructed of the same or similar materials to the enclosure, such as HDF, MDF, or wood. In some embodiments, base 302 may be constructed of a material heavier than the material used in the enclosure, such as natural or manmade stone (for example, granite) or metal (for example, steel).

Back base corner 306 may be exactly or substantially spatially a continuation of the edge between top corner 101 and bottom corner 102. In some embodiments, base 302 may be positioned such that left base corner 306 is at a continuation point of a line from top corner 101 to bottom corner 102.

In some embodiments, left base corner 307 may be at a continuation point of a line from top corner 101 to left corner 106. In some embodiments, right base corner 308 may be at a continuation point of a line from top corner 101 to right corner 105. In some embodiments, one or more sides of base 302 may be beveled. For example, the edges between left base corner 307 and right base corner 308, between back corner 306 and left base corner 307, and/or between back base corner 306 and right base corner 308 may be beveled, for example at angle(s) corresponding to the angle(s) of the face(s) of the enclosure above the respective edge(s), such that the edge is a continuation of the line(s) corresponding to such face(s) as described above.

In some embodiments, base 302 may be substantially the same dimensions (for example the same dimensions, or the same dimensions modulo corner truncation and/or rounding) as bottom face 107. In such embodiments, back base corner 306 may be exactly or substantially spatially a continuation of the edge between top corner 101 and bottom corner 102, while left base corner 307 and right base corner 308 may be at points defined by lines parallel to said edge, positioned at left corner 106 and right corner 105 respectively.

In some embodiments, base supports 303, 304, 305 may connect base 302 to the enclosure. Base support 303 may be positioned equidistant from front face 201 and right face 104 of FIG. 1A. Base support 304 may be positioned equidistant from front face 201 and left face 109 of FIG. 1B. Base support 305 may be positioned equidistant from right face 104 of FIG. 1A and left face 109 of FIG. 1B. In some embodiments, base supports 303, 304, 305 may be composed of the same material as base 302, such as stone or metal. In some embodiments, base supports 303, 304, 305 may be composed of or faced with the same material as the enclosure, such as wood, carbon fiber or wood veneer. In some embodiments, a single support may be employed, for example in the middle of bottom face 107. In such embodiments, bottom radiator 301 may be absent, or there may be multiple bottom radiators, for example as described for radiators 202, 203, 204 on front face 201 in conjunction with FIG. 2.

Figure 4:
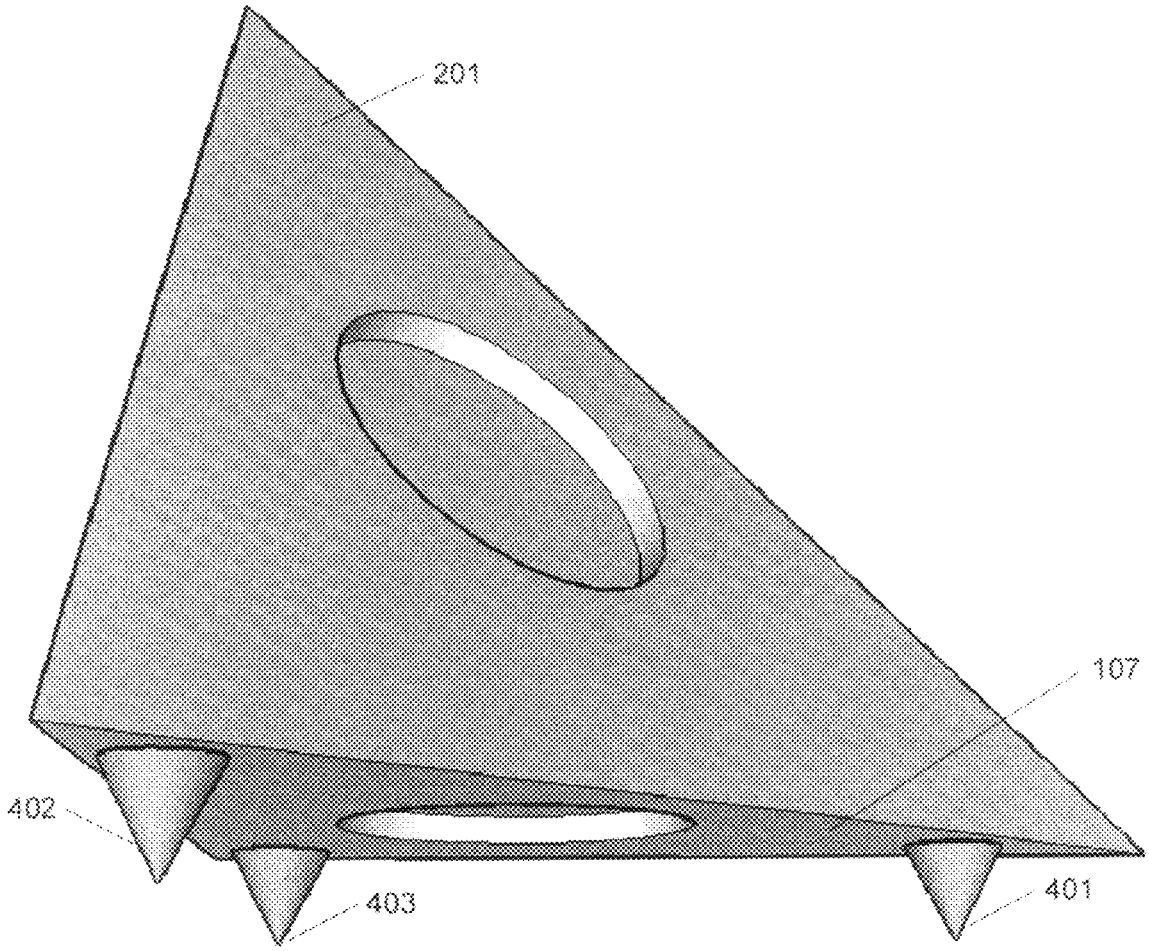
FIG. 4 is a diagram of a speaker enclosure with spikes, according to some embodiments.

FIG. 4 is a diagram of a speaker enclosure with spikes, according to some embodiments. In this example, spikes 401, 402, 403 are affixed to bottom face 107. Spikes 401, 402, 403 may be conical, may be thin cylinders, or may include a cylindrical portion affixed to bottom face 107 and a conical portion below, for example machined from the cylindrical sections. In various embodiments, the points of spikes 401, 402, 404 may be sharp, or may be rounded.

Spike 401 may be positioned equidistant from front face 201 and right face 104 of FIG. 1A. Spike 402 may be positioned equidistant from front face 201 and left face 109 of FIG. 1B. Spike 403 may be positioned equidistant from right face 104 of FIG. 1A and left face 109 of FIG. 1B.

Figure 5:
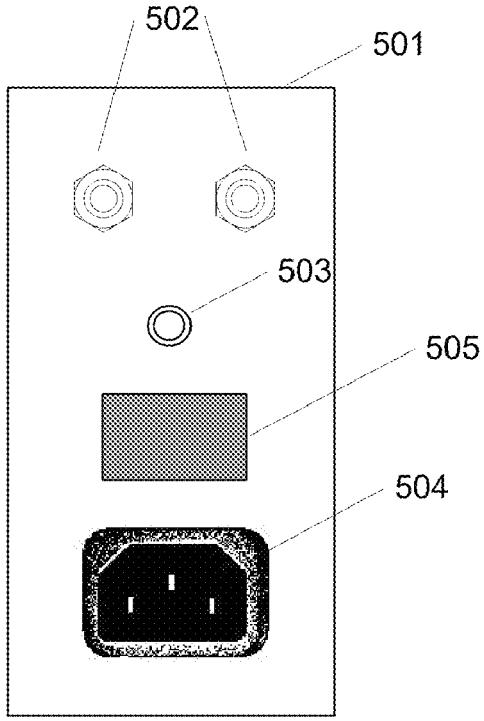
FIG. 5 is a diagram of a connector plate, according to some embodiments.

FIG. 5 is a diagram of a connector plate, according to some embodiments. In this example, a connector plate 501 is on the exterior of the enclosure. A plate may include a physical component affixed to the exterior, such as a metal, plastic or carbon fiber plate, or may be a flat area of the enclosure, such as a cut-away section at the back rear of the enclosure.

One or more audio connectors 502, such as two audio connectors, may receive speaker-level audio input, such as an audio input in the range of 3-20V. Examples of audio connectors 502 include any type of connector commonly used for speaker wire, such as binding posts, screws and spring connectors. In various embodiments, audio connectors 502 may receive a banana connector, a pin connector, a spade connector, or bare wire.

In some embodiments, a line-in connector 503 may receive line-level audio inputs, such as inputs with a nominal signal level of −10 dBV, +4 dBu, or +6 dBu. Examples of line-in connector 503 include an RCA connector, a ¼-inch phono plug, and a ⅛-inch mini phono plug. Line-in connector 503 may be connected to an input of an internal amplifier. In some embodiments, a wireless receiver 505 may be within the enclosure.

In some embodiments, a power plug 504 may receive input power, such as 110-120V AC or 220-240V AC power. Examples of a power plug include a female power plug into which a power cord may be plugged, or a power cord with a male plug that can be plugged into a wall power socket. In such embodiments, power from power plug 504 may power an internal amplifier and/or frequency-based filter.

Figure 6:
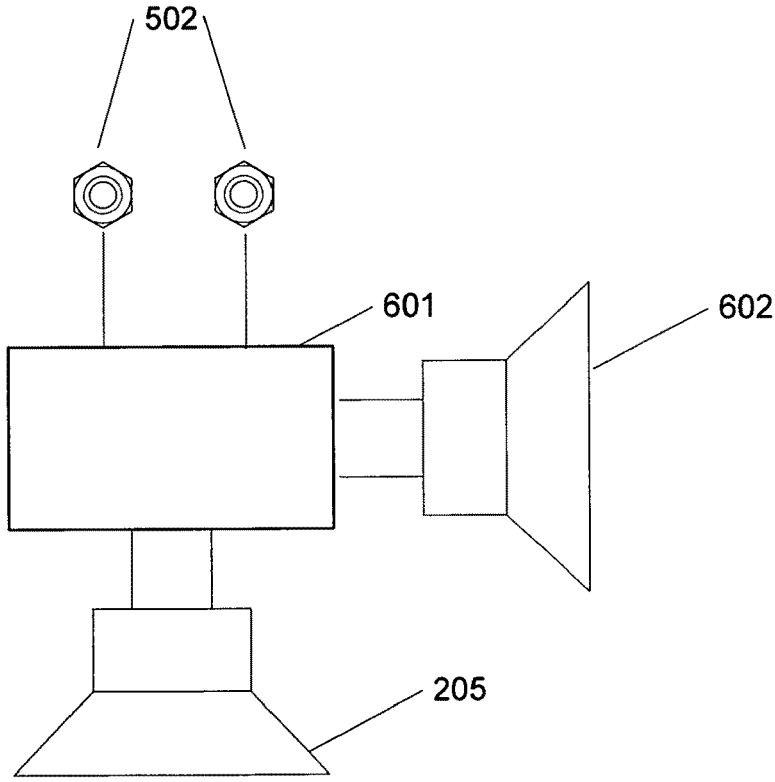
FIG. 6 is a diagram of electronic components of a speaker enclosure with an integral frequency-based filter, according to some embodiments.

FIG. 6 is a diagram of electronic components of a speaker enclosure with an integral frequency-based filter, according to some embodiments. In this example, one or more audio connectors 502 provide a speaker-level signal to frequency-based filter 601, which in some embodiments is within the loudspeaker enclosure.

Frequency-based filter 601 may clip or attenuate frequencies above an upper threshold, and/or attenuate signals progressively throughout an upper threshold range (e.g. using a low-pass filter or a band-pass filter), and/or may clip or attenuate frequencies below a lower threshold, and/or attenuate signals progressively throughout a lower threshold range (e.g. using a high-pass filter or a band-pass filter). An upper threshold or threshold range may be a threshold or threshold range above which subwoofer driver 205 provides poor sound reproduction, and/or above which other components are expected to provide good sound reproduction. Examples of an upper threshold range are 65-200 Hertz, 100-150 Hertz, and 200-300 Hertz. Examples of an upper threshold are 65, 85, 100, 150, and 300 Hertz. A lower threshold or threshold range may be a threshold or range below which subwoofer driver 205 provides poor sound reproduction, such as 20, 30, 40, or 50 Hertz, or a range having said frequencies as an upper or lower bound.

In this example, output from frequency-based filter 601 is provided to subwoofer driver 205. In some embodiments, output from frequency-based filter 601 may be provided 180 degrees out-of-phase relative to the input provided to subwoofer driver 205 (e.g. with reversed polarity) to an active radiator driver 602, which in some embodiments may be bottom radiator 301 of FIG. 3.

Figure 7:
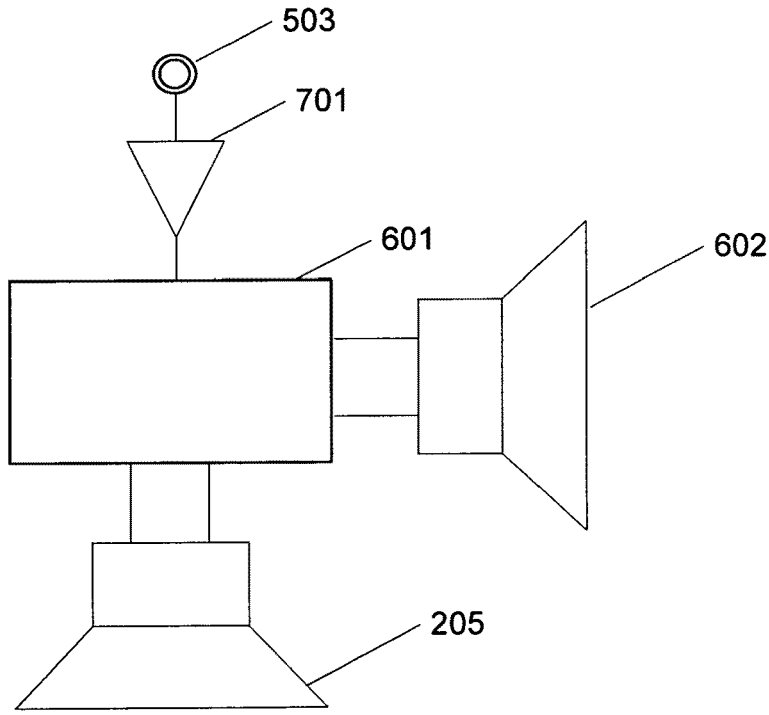
FIG. 7 is a diagram of electronic components of a speaker enclosure with an integral amplifier, according to some embodiments.

FIG. 7 is a diagram of electronic components of a speaker enclosure with an integral amplifier, according to some embodiments. In this example, a line-in connector 503 receives a line-level signal and provides it to amplifier 701, which in various embodiments may be a class A, class B, class AB, class C or class D amplifier. Amplifier 701 may provide a speaker-level signal to frequency-based filter 601, as discussed in conjunction with FIG. 6. Frequency-based filter 601 may provide a speaker-level signal to subwoofer driver 205. In some embodiments, output from frequency-based filter 601 may be provided 180 degrees out-of-phase relative to the input provided to subwoofer driver 205 (e.g. with reversed polarity) to an active radiator driver 602, which in some embodiments may be bottom radiator 301 of FIG. 3.

In some embodiments, frequency-based filter 601 may be absent. In such embodiments, amplifier 701 may provide a speaker-level signal to subwoofer driver 205. In some such embodiments, output from amplifier 701 may be provided 180 degrees out-of-phase relative to the input provided to subwoofer driver 205 (e.g. with reversed input polarity) to active radiator driver 602.

In some embodiments, frequency-based filter 601 may be connected to line-in connector 503, from which is receives a line-level signal. In such embodiments, frequency-based filter 601 processes the line-level signal and provides a line-level output to amplifier 701, which in turn provides a speaker-level signal to subwoofer driver 205 and, in some embodiments, a 180-degree out-of-phase signal as discussed above to active radiator driver 602.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A trirectangular tetrahedral subwoofer enclosure, comprising:

a first face, a second face, a third face, and a fourth face, wherein the first face, the second face, the third face, and the fourth face are substantially triangular;

a first corner, wherein the first corner is at an intersection of the first face, the second face, and the third face;

a second corner, wherein the second corner is at an intersection of the first face, the second face, and the fourth face;

a third corner, wherein the third corner is at an intersection of the first face, the third face, and the fourth face;

a fourth corner, wherein the fourth corner is at an intersection of the second face, the third face, and the fourth face;

wherein an angle between the first corner and a midpoint between the third corner and the fourth corner, having the second corner as its vertex, is substantially ninety degrees; and wherein an angle between the third corner and the fourth corner, having the second corner as its vertex, is substantially ninety degrees; and wherein an angle between the first corner and the third corner, having the second corner as its vertex, is substantially ninety degrees; and wherein an angle between the first corner and the fourth corner, having the second corner as its vertex, is substantially ninety degrees; and wherein a first dihedral angle between the first face and the third face is substantially equal to the inverse cosine of the square root of two thirds of a radian, subtracted from pi divided by two radians; and wherein a second dihedral angle between the second face and the third face is substantially equal to the inverse cosine of the square root of two thirds of a radian, subtracted from pi divided by two radians; and wherein a third dihedral angle between the fourth face and the third face is substantially equal to the inverse cosine of the square root of two thirds of a radian, subtracted from pi divided by two radians; and at least one active driver, wherein one of the at least one active driver is a subwoofer driver attached to the third face, and wherein every one of the at least one active driver has a free air resonant frequency less than one hundred Hertz.

2. The enclosure of claim 1, wherein the fourth face includes a port.

3. The enclosure of claim 1, wherein the fourth face includes a passive driver.

4. The enclosure of claim 1, wherein the fourth face includes an active driver.

5. The enclosure of claim 4, wherein a first signal provided to the active driver is 180 degrees out of phase with a second signal provided to the subwoofer driver.

6. The enclosure of claim 1, further comprising a base, wherein the base is substantially triangular.

7. The enclosure of claim 6, wherein the base is attached to the fourth face.

8. The enclosure of claim 6, wherein the composition of the base includes stone.

9. The enclosure of claim 1, wherein the composition of the third face includes wood.

10. The enclosure of claim 1, wherein the composition of the third face includes stone.

11. The enclosure of claim 1, wherein the composition of the first face, the second face, and the fourth face includes high-density fiber board.

12. The enclosure of claim 1, wherein the composition of the first face, the second face, and the fourth face includes carbon fiber.

13. The enclosure of claim 1, wherein the third face includes a port.

14. The enclosure of claim 1, wherein the third face is equilateral.

15. The enclosure of claim 1, further comprising a low-pass filter.

16. The enclosure of claim 15, further comprising a high-pass filter.

17. The enclosure of claim 1, further comprising an integral amplifier.

18. The enclosure of claim 1, wherein at least one of the first corner, the second corner, the third corner, and the fourth corner is truncated.

19. The enclosure of claim 1, wherein the first face and the second face include at least one of a port, a passive driver, and an active driver.

20. The enclosure of claim 1, further comprising a wireless receiver configured to receive radio-frequency signals and convert them to electrical signals encoding audio.

* * * * *